US005797073A

United States Patent [19]

Russell

[11] Patent Number: 5,797,073

[45] Date of Patent: Aug. 18, 1998

[54] TONER CONTAINER WITH BIASED CLOSURE

[75] Inventor: Robert D. Russell, Pittsford, N.Y.

[73] Assignee: Xerox Corporation, Stamford, Conn.

[21] Appl. No.: 816,310

[22] Filed: Mar. 13, 1997

[51] Int. Cl.[6] ..... G03G 15/08

[52] U.S. Cl. ..... 399/260; 222/167; 222/DIG. 1; 399/262

[58] Field of Search ..... 399/258, 260, 399/262, 252, 120; 141/256, 346, 364; 222/DIG. 1, 167, 241, 325

[56] References Cited

U.S. PATENT DOCUMENTS

| | | | |
|---|---|---|---|
| 4,650,097 | 3/1987 | Hagihara et al. | 222/DIG. 1 X |
| 4,878,603 | 11/1989 | Ikesue et al. | 141/256 |
| 4,937,628 | 6/1990 | Cipolla et al. | 399/262 X |
| 4,941,022 | 7/1990 | Ohmura et al. | 399/358 |
| 4,990,964 | 2/1991 | Kraehn | 399/261 |
| 5,057,872 | 10/1991 | Saijo et al. . | |
| 5,089,854 | 2/1992 | Kaieda et al. | 399/262 |
| 5,200,787 | 4/1993 | Nishiguchi | 399/359 |
| 5,296,900 | 3/1994 | Saijo et al. | 399/260 |
| 5,383,502 | 1/1995 | Fisk et al. | 141/364 |
| 5,441,177 | 8/1995 | Yanagisawa | 222/167 |
| 5,455,662 | 10/1995 | Ichikawa et al. | 399/260 |
| 5,495,323 | 2/1996 | Meetze, Jr. | 399/120 |

FOREIGN PATENT DOCUMENTS

| | | |
|---|---|---|
| 5-127524 | 5/1993 | Japan . |
| 8-146740 | 6/1996 | Japan . |

*Primary Examiner*—Arthur T. Grimley
*Assistant Examiner*—Sophia S. Chen
*Attorney, Agent, or Firm*—John S. Wagley

[57] ABSTRACT

A device for storing a supply of particles for use in a developer unit of an electrophotographic printing machine is provided. The device includes an open ended container defining a chamber in communication with the open end thereof. The particles are stored in the chamber of the container. The device also includes a member cooperating with the container to urge the container in the direction of the open end. The member defines a longitudinal axis thereof. The member is collapsible in the direction of the longitudinal axis. The member includes a body defining a cavity therein.

18 Claims, 8 Drawing Sheets

TONER CONTAINER WITH BIASED CLOSURE

The present invention relates to a developer apparatus for electrophotographic printing. More specifically, the invention relates to a container for storing toner.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable marking particles typically in the form of a powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll."

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll.

In an electrophotographic printer as the toner within the developer material is transferred to the photoreceptor and eventually to the copy paper, this used toner must be replaced. The electrophotographic printer thus includes a toner container or cartridge from which fresh toner is dispensed into the machine. When using two component developer, a portion of the carrier granules will eventually deteriorate. Additional new carrier granules may be added to the machine to replace the deteriorated granules. The toner container or cartridge may thus alternatively store a mixture including a small quantity of carrier granules in addition to the toner. To provide for a small compact toner cartridge and to provide for a toner cartridge in which the opening to the cartridge may be easily removed, the toner cartridge typically has a compact shape with a small opening from which the toner is dispensed.

Traditionally when all the toner within the container had been consumed, additional toner was supplied to the machine by pouring toner from a separate refilling bottle into the container. This method permitted many toner particles to become airborne during filling and enter the machine. The operator may even miss the opening of the container during filling and spill large quantities of toner inside the machine. Since the toner is inherently very susceptible to electrostatic charges, the toner sticks electrostatically to all the remote recesses of the machine making cleaning of the machine necessary, time consuming, and expensive.

Recently, machines have been supplied with replaceable toner containers or cartridges to avoid some of the problems associated with spilling toner during refilling. While missing the opening of the container during filling and spilling large quantities of toner is alleviated by replaceable toner containers, spillage can occur from the old container during removal and from the new container during installation.

Toner in the toner container or cartridge must be fed therefrom to the latent image to effectuate development. Typically, toner containers are located with their openings in the bottom of the container whereby they may be emptied by gravity. In attempts to make inexpensive and compact electrophotographic printers and to minimize space and related costs, however, the shape of the toner container may not be conducive to a bottom opening or to an unassisted emptying of the container. This is particularly true for wide format copiers and printers. When the opening is not in the bottom or the geometry of the container does not promote the free flow of all the contents, a mechanism must be provided for removing the toner therefrom. While the demand for toner remains fairly constant, these mechanisms expel large quantities of toner when the container is full and progressively smaller amounts as the container empties. Typically the toner containers are cylindrical and the toner is removed therefrom by rotating the container and/or a member within the container, such as a spiral wire.

Cylindrical toner containers are now available with spiral ribs located therein, which when rotated urge the toner to the end thereof. These containers have an opening in the periphery of the container near one end thereof through which toner escapes. A machine interface which must be sealed to the container is used to remove toner from the opening. Typically the dispensing hole is covered with a removable seal to contain the toner during shipment. The seal is removed prior to installation of the container. An example of a prior art container is shown in U.S. Pat. No. 5,495,323 to Meetze, Jr. the relevant portions thereof incorporated herein by reference.

A typical prior art cylindrical toner container 1 is shown in FIG. 6. The container 1 includes a integrally molded spiral rib 2 located on the inner periphery thereof. The spiral rib 2 serves to move the toner located within toward dispensing end 3 of the container. Opening 4 of the container is located near the periphery of the container 1 adjacent first end 3. The seal (not shown) of the opening 4 is removed prior to the installation of the container 1. The opening 4 must be located toward the top along vertical axis 5. The container 1 is rotated in the direction of arrow 6 by motor 7. The motor 7 positions the container 1 such that upon container removal and refilling, the opening 4 is located along the vertical axis 5. This is typically accomplished by use of a sensor 8 which cooperates with a feature 9 on the periphery of the container 1 to indicate when the motor 7 should stop to provide for the opening 4 in the vertical position. The addition of the sensor 8 as well as the feature 9 increases the cost and complexity of such a toner container 1.

The following disclosures may be relevant to various aspects of the present invention:

U.S. Pat. No. 5,495,323
Patentee: Meetze, Jr.
Issue Date: Feb. 27, 1996

U.S. Pat. No. 5,455,662
Patentee: Ichikawa et al.
Issue Date: Oct. 3, 1995

U.S. Pat. No. 5,383,502
Patentee: Fisk et al.
Issue Date: Jan. 24, 1995

U.S. Pat. No. 5,200,787
Patentee: Nishiguchi
Issue Date: Apr. 6, 1993

U.S. Pat. No. 5,089,854
Patentee: Kaieda et al.
Issue Date: Feb. 18, 1992

U.S. Pat. No. 5,057,872
Patentee: Saijo et al.
Issue Date: Oct. 15, 1991

U.S. Pat. No. 4,990,964
Patentee: Kraehn
Issue Date: Feb. 5, 1991

U.S. Pat. No. 4,941,022
Patentee: Ohmura et al.
Issue Date: Jul. 10, 1990

U.S. Pat. No. 4,878,603
Patentee: Ikesue et al.
Issue Date: Nov. 7, 1989

The relevant portions of the foregoing disclosures may be briefly summarized as follows:

U.S. Pat. No. 5,495,323 discloses a device for storing a supply of particles for use in a developer unit of an electrophotographic printing machine. The device comprises an open ended container defining a chamber in communication with the open end thereof. The particles are stored in the chamber of the container. The device further comprises a puncturable seal attached to the open end of the container for sealing the chamber. The container is installable into the developer unit without removal of the seal.

U.S. Pat. No. 5,455,662 discloses a developer replenishing device for replenishing a developing device with a developer and a developer container for use therewith. The developer container or toner bottle has a mouth portion at one end thereof which is smaller than in diameter than a hollow cylindrical main body. At the end of the bottle provided with the mouth, a shoulder has the inner periphery thereof partly raised to the edge of the mouth portion to form a raised portion for scooping up toner.

U.S. Pat. No. 5,383,502 discloses an imaging material replenishing system including a toner container removably insertable into an insertion guide member. The container has a containment lid unit which is automatically opened upon insertion. A lid latching member which includes a lid latching notch normally latches the containment lid to the container.

U.S. Pat. No. 5,200,787 discloses a developing unit including a valve at the junction of the first toner transport channel and the second transport channel. The valve is normally closed, but is opened when the toner collection bottle has been filled.

U.S. Pat. No. 5,089,854 discloses a device for assisting the removal of toner from a toner bottle. The device includes a vertically oriented toner bottle having an opening formed in a cap portion at its lower end and a bellows which may be extended or shrunk by pushing the top portion of the toner bottle downward to eject toner in the bottle out of the bottle.

U.S. Pat. No. 5,057,872 discloses a developer supplying device which includes a substantially cylindrical developer container having on its peripheral surface a spiral groove and being able to rotate to transport a developer therein by the groove. The device includes a supplying element in the form of an opening and a regulating device.

U.S. Pat. No. 4,990,964 discloses a toner delivery system including a toner bottle having an opening in the top end thereof. The toner is removed from the bottle by a vertically oriented suction spout to which a bellows is attacked for extracting the toner therefrom. A handle is located above the bellows and attached thereto to assist an operator in manually actuating the bellows.

U.S. Pat. No. 4,941,022 discloses a toner recovery device for collecting toner from a cleaning device into a recovered toner container. The recover opening of the container is covered with a shutter. The shutter is opened and closed by an operating lever.

U.S. Pat. No. 4,878,603 discloses a toner replenishing device for replenishing toner to a toner storage area, from where the toner is supplied to a developing section. The device includes a holder for releasably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position and receiving the first mating member.

According to the present invention, there is provided a device for storing a supply of particles for use in a developer unit of an electrophotographic printing machine. The device includes an open ended container defining a chamber in communication with the open end thereof. The particles are stored in the chamber of the container. The device also includes a member cooperating with the container to urge the container in the direction of the open end. The member defines a longitudinal axis thereof. The member is collapsible in the direction of the longitudinal axis. The member includes a body defining a cavity therein.

According to the present invention, there is also provided a developer unit for developing a latent image recorded on an image receiving member with a supply of particles. The developer unit includes an open ended container defining a chamber in communication with the open end thereof. The particles are stored in the chamber of the container. The device also includes a member cooperating with the container to urge the container in the direction of the open end. The member defines a longitudinal axis thereof. The member is collapsible in the direction of the longitudinal axis. The member includes a body defining a cavity therein.

According to the present invention, there is further provided an electrophotographic copy machine for developing with a supply of particles a latent image recorded on an image receiving member. The copy machine including a developer unit. The developer unit includes an open ended container defining a chamber in communication with the open end thereof. The particles are stored in the chamber of the container. The device also includes a member cooperating with the container to urge the container in the direction of the open end. The member defines a longitudinal axis thereof. The member is collapsible in the direction of the longitudinal axis. The member includes a body defining a cavity therein.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 7 printing machine will be shown hereinafter schematically and their operation described briefly with reference thereto.

Figure 7:
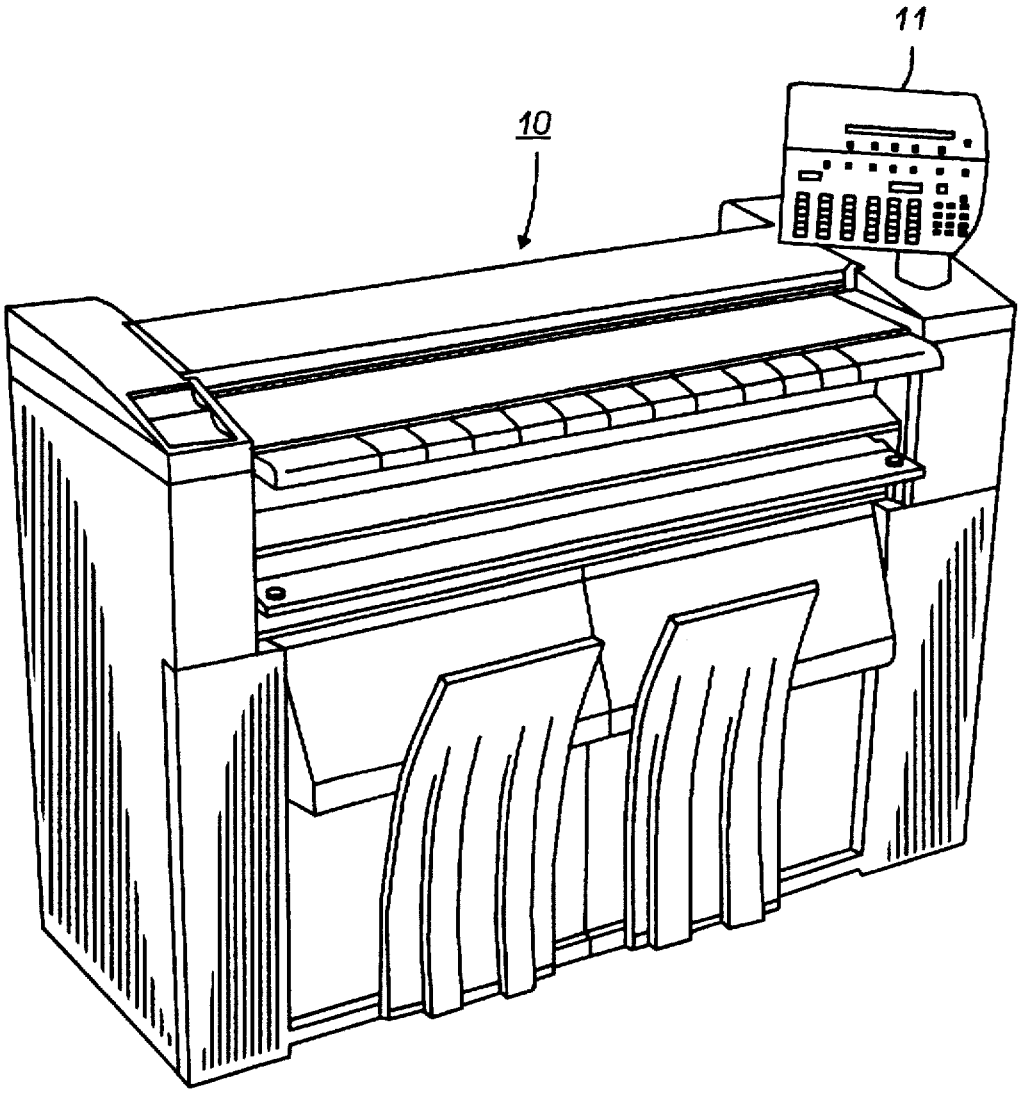
FIG. 7 is a schematic elevational view of an illustrative electrophotographic printing machine incorporating the molded spring biased toner bottle of FIG. 5.
Figure 8:
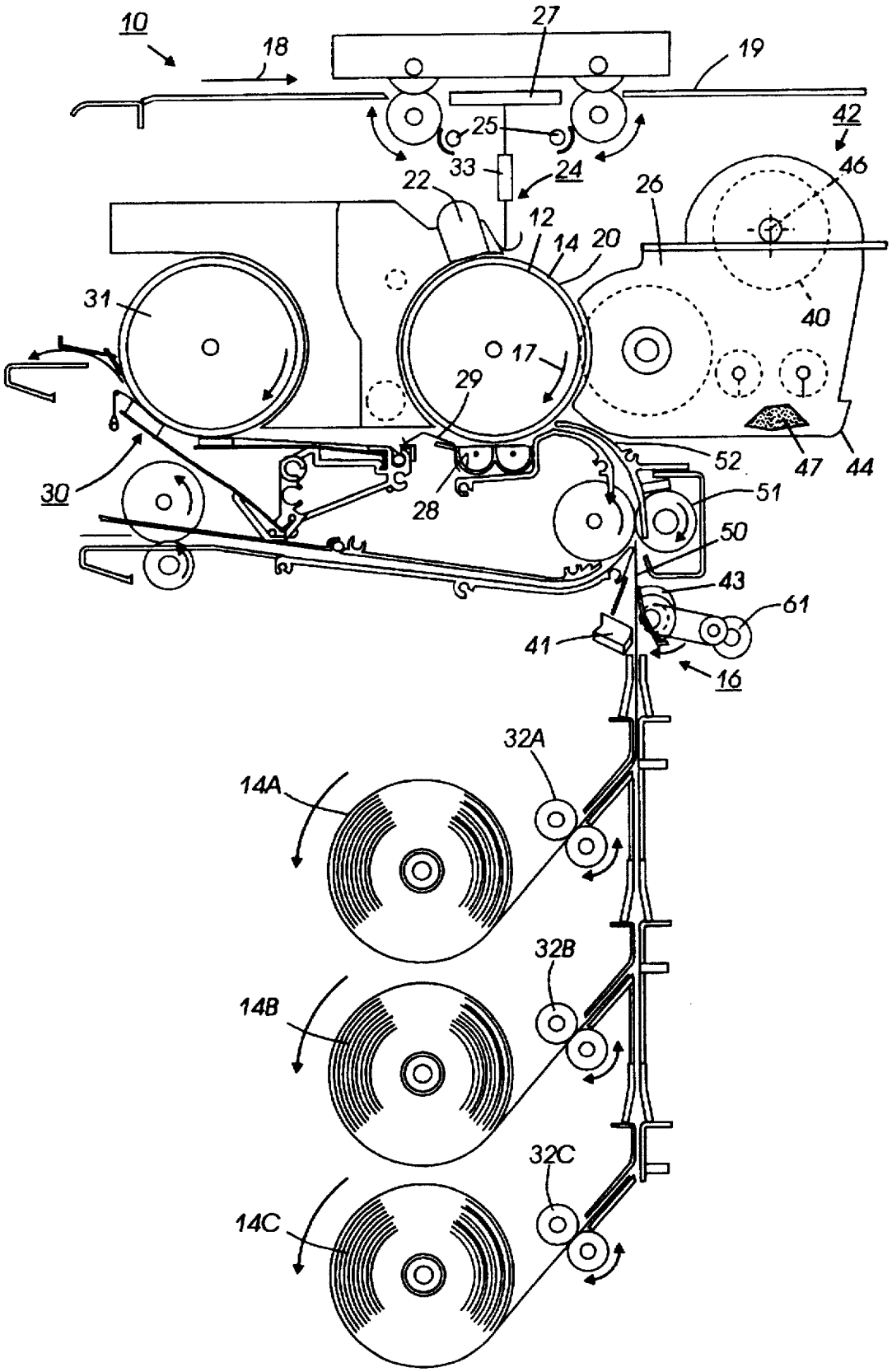
FIG. 8 is a partial schematic side view of the machine of FIG. 7 showing the position of the biased closure toner bottle of the present invention mounted onto the developer housing of FIG. 1.

Referring to FIGS. 7 and 8 of the drawings there is shown by way of example an automatic xerographic reproduction or printing machine, designated generally by the numeral 10 incorporating the post transfer corrugator structure of the present invention.

Referring now to the drawings in detail wherein like numbers represent like elements, in FIG. 7 a wide format copier/printer 10 including a control panel 11 is shown which is especially adapted to copy large documents. Documents to be copied are fed in from the front of the machine, pass through an exposure zone and exit out of the back of the machine.

FIG. 8 shows a side internal view of the copier/printer machine 10. Machine 10 includes an electrostatic drum 20 with xerographic stations arranged around its periphery, which carry out the operational steps of the copying process. These stations include charging station 22, exposure station 24, developing station 26, transfer station 28 and fusing station 30. Documents fed along platen 19 in the direction of arrow 18 are imaged onto the surface of drum 20, at exposure station 24. The operations of the stations are conventional and are described, for example, in U.S. Pat. Nos. 4,821,974; 4,996,556; and 5,040,777, whose contents are incorporated herein by reference.

Copy media, which may be bond paper, vellum, or the like, is cut from the selected media roll assembly 14A, 14B or 14C and is fed by a respective feed roller pair 32A, 32B or 32C. The sheet to be cut is guided along a vertical path between baffle pairs into sheet cutting bar assembly 16 which includes a stationary blade 41 and a rotating cutting bar 43 that includes a helical cutting blade. Cutter bar 43 is shown in the home position which is about 30° of rotation away from the cutting position and is driven by motor 61. Cutter assembly 16 is of the conventional type described, for example, in U.S. Pat. No. 4,058,037. Initiated by a cutter operation signal, bar 43 rotates in the direction of the arrow with its blade moving against blade 41 to sheer a sheet 50 from the roll media with a straight cut. The cut sheet is transported after registration by roller pair 51 into baffle 52 and then into transfer station 28 where a developed image is transferred onto the sheet. The cut sheet is then forwarded over post transfer corrugator 29, through fuser 31 at fuser station 30 and out of the machine. It should be appreciated that the printing machine may likewise include a photoreceptor in the form of a belt (not shown) in place of the drum 20. The drum 20 has a photoconductive surface layer 12 on an electroconductive substrate 14. Preferably the surface 12 is made from a selenium alloy. The substrate 14 is preferably made from an aluminum alloy which is electrically grounded. The drum is driven by means of motor(not shown), the direction of movement being clockwise as viewed and as shown by arrow 17. Initially a portion of the drum 20 passes through a charge station 22 at which a corona generator (not shown) charges surface 12 to a relatively high, substantially uniform, potential.

Next, the charged portion of photoconductive surface 12 is advanced through exposure station 24. At exposure station 24, imaging of the document is achieved by lamps 25 which illuminate the document on a platen 27. Light rays reflected from the document are transmitted through lens 33. Lens 33 focuses light images of the document onto the charged portion of the photoconductive drum 20 to selectively dissipate the charge thereon. This records an electrostatic latent image on the photoconductive belt which corresponds to the informational areas contained within the original document. Thereafter, drum 20 advances the electrostatic latent image recorded thereon to development station 26.

After the electrostatic latent image has been recorded on photoconductive surface 12, drum 20 advances the latent image to development station 26 as shown in FIG. 8. The development station 26 develops the latent image recorded on the photoconductive drum 20. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 8, after the electrostatic latent image has been developed, drum 20 advances the developed image to transfer station 28, at which a copy sheet is advanced by rollers 51 and baffle 52 into contact with the developed image on drum 20. A corona generator is used to spray ions onto the back of the sheet so as to attract the toner image from drum 20 onto the sheet. As the drum 20 turns, the sheet is stripped therefrom with the toner image thereon.

After transfer, the sheet is advanced by a conveyor (not shown) to fusing station 30. Fusing station 30 includes a heated fuser 31. The sheet passes fuser roller 31 with the toner powder image contacting fuser roller 31. In this way, the toner powder image is permanently affixed to the sheet. After fusing, the sheet advances for subsequent removal from the printing machine by the operator.

After the sheet is separated from photoconductive surface 12 of drum 20, the residual toner particles adhering to photoconductive surface 12 are removed therefrom at cleaning station (not shown) by a rotatably mounted fibrous brush in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

According to the present invention and referring again to FIG. 8, a particle storage device 40 is shown. The particle storage device 40 is located within developer unit 42 and is secured to developer housing 44. The particle storage device 40 is positioned relative to the horizontal such that longitudinal axis 46 of the device 40 is located horizontally. The horizontal orientation of the storage device 40 is particularly well suited for copying large documents. In machines for copying large documents, the drum 20 is by necessity long and thus typically the machine has an extended length in the horizontal longitudinal axis. This necessitates a longitudinally extended developer unit shape. A longitudinally extending storage device 40 is the thus the most efficient shape for this developer unit.

Figure 5:
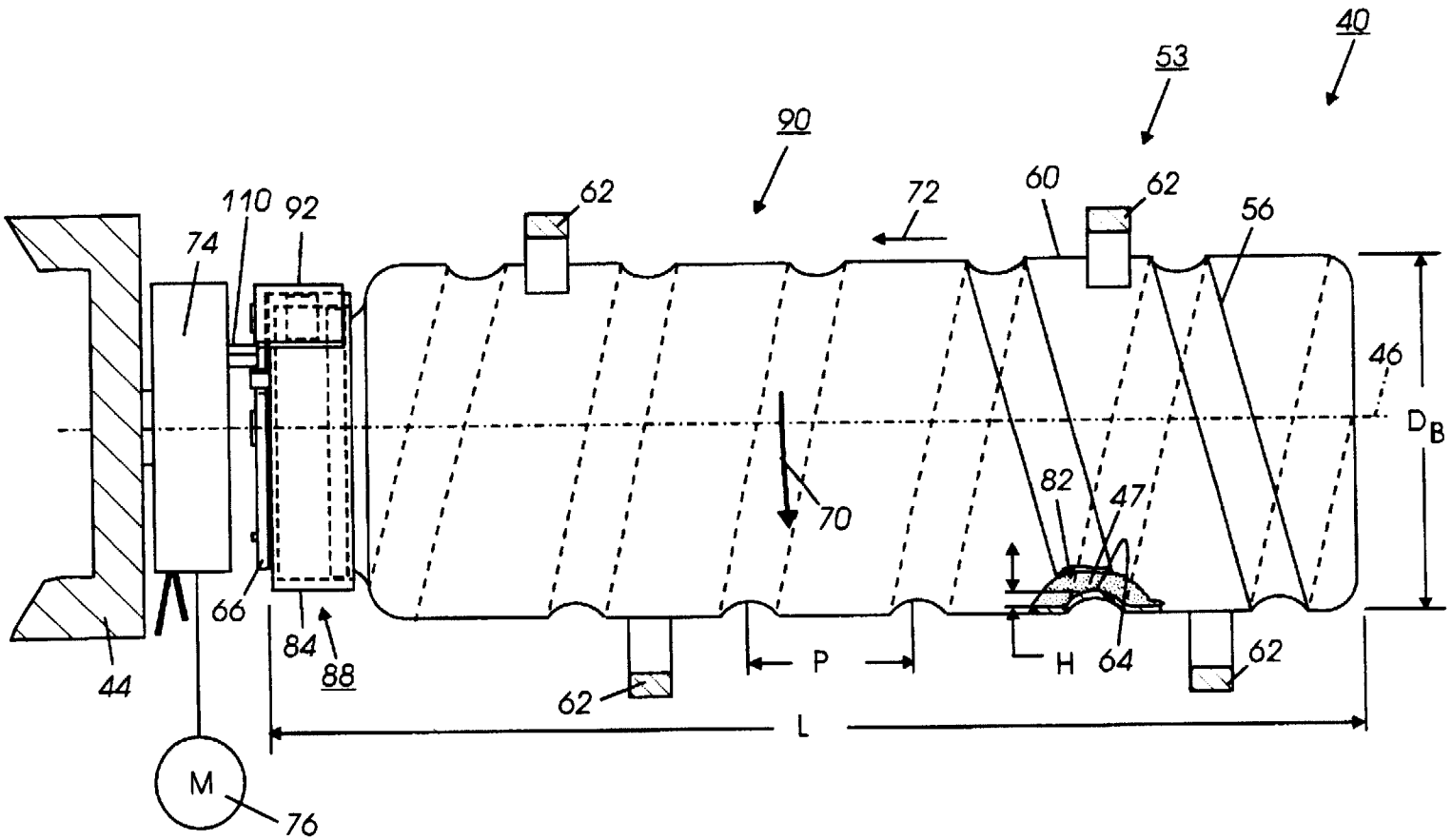
FIG. 5 is a plan view of a toner bottle having a biased closure according to the present invention with the closure in a relaxed position.
Figure 6:
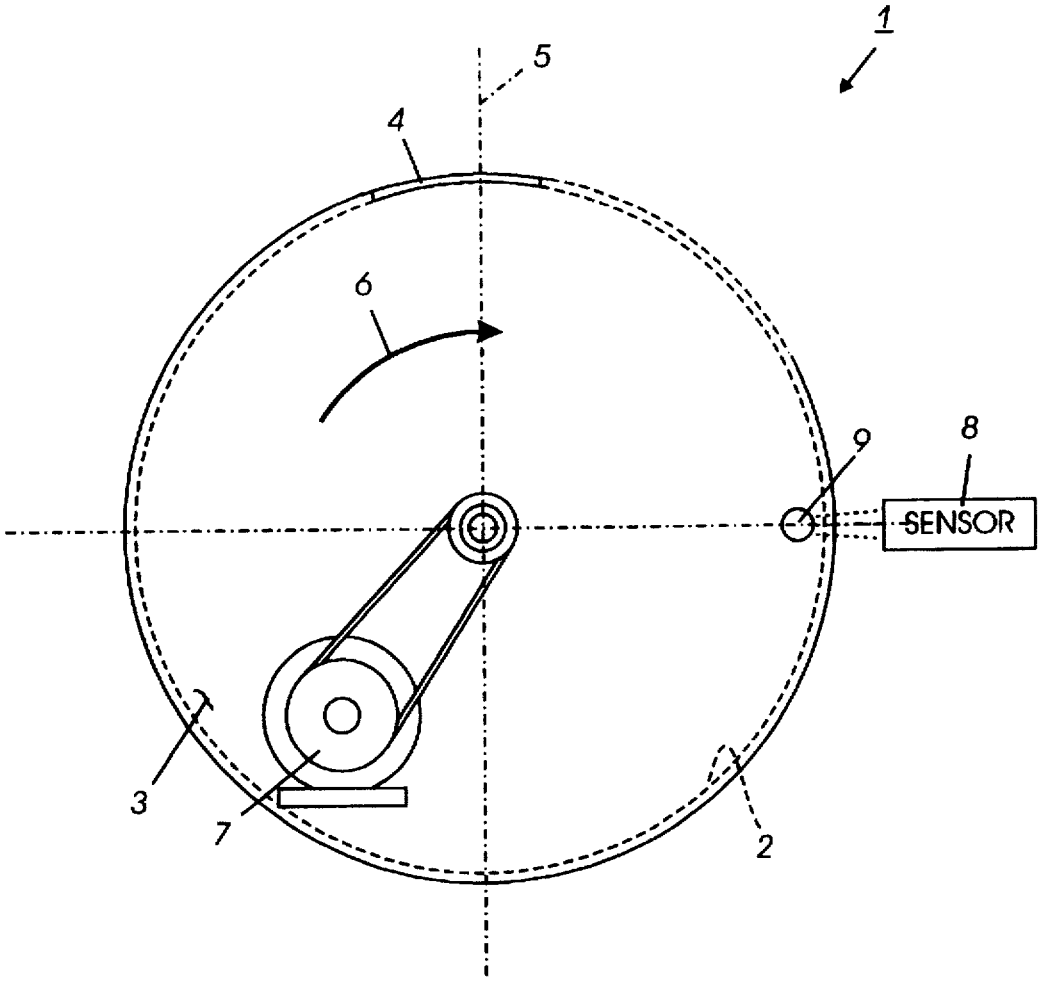
FIG.6 PRIOR ART
FIG. 6 is an end view of a prior art toner bottle depicting the use of a sensor for use in radially orienting the opening of the bottle.

Referring now to FIG. 5, the device 40 includes a container 53 defining an aperture 68 in the form of an opening through which the developer material 47 including at least marking particles is dispensed.

The container 53 may have any suitable shape and configuration capable of containing the developer material 47. For example, the container 53 may have a generally cylindrical shape and contain within the hollow container 53 a spirally shaped spring or auger (not shown) for urging the developer material 47 within the container 53 toward the developer housing 44. Preferably, however, the container 53 includes spiral ribs 56 formed in periphery 60 of the container 53. Such a container with integral spiral ribs is disclosed in U.S. Pat. No. 5,495,323 to Meetze, Jr., the relative portions thereof incorporated herein by reference.

The container 53 is preferably supported by supports 62 in the form of a V or similarly shaped cradle 62. The container 53 may thus be replaced by lifting the container 53 in a vertical direction away from the cradle 62.

The internal periphery 64 of the spiral ribs 56 which are located on periphery 60 of the container 53 urge the developer material 47 toward dispensing end 66 of the container 53. The container 53 is rotated in the direction of arrow 70 whereby the spiral ribs 56 progress the material 47 in the direction of arrow 72. The container 53 is rotated by any suitable device for example a drive motor 76 or by a common motor (not shown) connected to the container 53 by a drive train (not shown). The drive motor 76 may be connected to the container 53 by any suitable method, i.e. by drive mechanism 74.

Referring again to FIG. 5, the container 53 is shown in greater detail. The container 53 may have any suitable size necessary to store a sufficient quantity of developer material 47 within chamber 82 of the container 53. For example, the container 53 may have a length L of approximately 6 inches and a diameter $D_B$ across the external periphery 60 of the container 53 of approximately 3 inches.

The ribs 56 form an internal protrusion or height H along which the material 47 progress. The height H may be any suitable height necessary to translate sufficient quantities of developer material 47 toward dispensing end 66 of the container 53. For example, the height H may be approximately 0.2 inches. To provide for a sufficient quantity of material 47 progressing toward the dispensing end 66 of the container, the pitch P or distance between adjacent ribs 56 may be adjusted to provide for a larger or smaller quantity of material 47 moving toward the dispensing end 66. For example, the pitch P may be approximately 1 inch.

The container 53 may be made of any suitable durable material and may for example be made of acetyl or polyethylene. The container 53 may likewise be made of a glass filled polycarbonate for increased strength. When made of acetyl or polyethylene, the container 53 may have a thickness T sufficient to maintain the strength of the container 53, for example, the thickness T may be approximately 0.020 to 0.050 inches.

The container 53 may be made by any suitable method, for example, the container 53 may be blow molded by a suitable blow molding process. Such a process is described in U.S. Pat. No. 4,101,617 to Friedrich, the relative portions thereof incorporated herein by reference.

To permit the material 47 from exiting the container 53, the container 53 includes the opening 68 from which the material 47 is dispensed from the container 53. The opening 68 may have any suitable shape, for example, include a round aperture or square or rectangular aperture. The cross sectional area of the opening 68 is selected to provide for the proper amount of material 47 to be distributed from the container depending on the need of the copy machine (not shown). The opening 68 is preferably located on periphery 84 of the dispensing end 66 of the container 53. The container 53 may be integrally molded or may include a dispensing portion 88 which includes the opening 68 and a spiral portion 90 which includes the integrally molded ribs 56.

With each rotation of the container 53 in the direction of arrow 70, the opening 68 moves from an opening upward position as shown in FIG. 5, toward an opening downward position and back to an opening upward position. With each rotation of the container 53, the opening thus cycles about the periphery 84 of the container 53 permitting a defined amount of material 47 to be dispensed from the container 53.

According to the present invention and referring to FIG. 5, the particle storage device 40 includes a member 92 for selectably opening and closing the opening 68. The member 92 serves to selectably open and close the opening 68. The member 92 has a first position relative to the container 53 in which the member 92 closes the opening 68. This first position is shown in FIG. 1.

Figure 1:
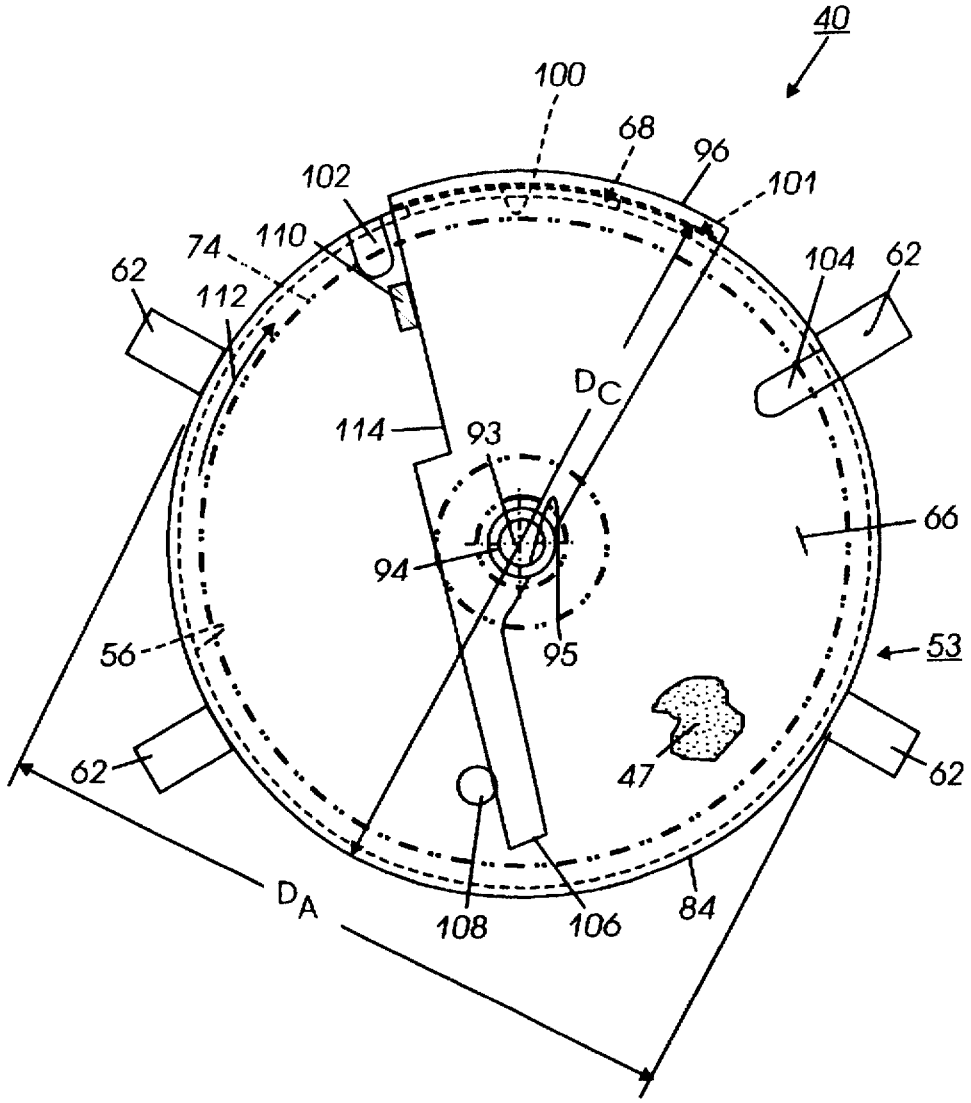
FIG. 1 is an end view of the FIG. 5 toner bottle showing the biased closure in the closed position.

Referring now to FIG. 1, when the member 92 of the particle storage device 40 is in the first position, the device 40 is sealed permitting the installation of the particle storage device 40 into the copy machine in any angular position. This feature precludes the need of stopping the particle storage device 40 in any particular angular orientation. Furthermore, the member 92 with the feature of selectably opening and closing the opening 68 permits the container 53 to be inserted in any angular position thus simplifying the installation of the particle storage device 40.

While the member 92 may have any suitable configuration for selectively opening and closing the aperture, preferably, as shown in FIG. 1, the member 92 is in the form of a pivoting door 92. The door 92 is thus pivotally connected to the container 53. The connection between the container 53 and the door 92 may be accomplished in any suitable fashion. For example, the container 53 may include a protrusion 94 extending from dispensing end 66 of container 53. The protrusion 94 may have a generally cylindrical shape. The pivoting door 92 may include a cylindrical opening or bore 95 which matingly fits with protrusion 94. The pivoting door 92 thus is permitted to rotate about protrusion 94 of the container 53. The door 92 is secured to the container 53 in any suitable fashion such as by a flexible tab (not shown) on the end of the protrusion 94. Likewise, the protrusion 94 may include a groove (not shown) or other feature to which a separate retaining device (not shown) is secured.

To provide for sealing of opening 68, the pivoting door 92 includes a closure or cover portion 96. The closure or cover portion 96 matingly fits with outer periphery 84 of the dispensing end 66 of the container 53. The closure or cover portion 96 thus includes an inner periphery 100 which mates with the outer periphery 84 of the dispensing end 66 of the container 53. The inner periphery 100 is defined by a diameter Dc which is slightly larger than diameter $D_A$ defining the outer periphery 84 of the dispensing end 66 of the container 53. A plastic foam seal 101 made of a suitable durable resilient material, for example a resilient foam, for example polypropylene.

While it may preferable to not have a temporary seal, the device 40 may include a temporary seal (not shown) for sealing the material 47 within the container 53 during shipment. The container 53 may have the opening 68 at the dispensing end 66 covered by a removable cover seal (not shown) adhesively applied to the container 53. The cover seal may be made of any suitable material that is preferably gas permeable. For example, TYVEC®, a product of E. I. duPont de Nemours and Company, is suitable for this purpose.

The cover portion 96 of the pivoting door 92 is restrained in its pivoting motion between a door closed stop 102 and a door opened stop 104. The stops 102 and 104 may have any suitable configuration capable of restraining the pivoting door 92. For example, as shown in FIG. 1, door closed stop 102 may be in the form of a protrusion extending from the dispensing end 66 of the container 53. The door opened stop 104 may similarly be in the form of a protrusion extending from the dispensing end 66 of the container 53. In the door closed position as shown in FIG. 1, the pivoting door 92 is positioned adjacent the door closed stop 102. In this position, the cover portion 96 is in alignment with opening 68 sealing the material 47 within the container 53.

The pivoting door 92 is nominally positioned with the closure 96 adjacent the door closed stop 102 by any suitable feature. For example, the pivoting door 92 may include an arm 106 extending outwardly from the centerline 93 of the bore 95 of the pivoting door 92. The arm 106 may cooperate with any other feature to position the cover portion 96 adjacent the door closed stop 102. For example, the container 53 may include a spring stop 108 in the form of a protrusion extending outwardly from the dispensing end 66 of the container 53 and being integral therewith. It should be appreciated that the cover portion 96 may be urged against the door close stop 102 by any other suitable urging means, e.g., a metal spring or an elastic member.

As shown in FIG. 1, when the device 40 is located outside the copy machine, the cover portion 96 covers the opening 68 preventing marking particles from leaking from the device 40. Thus, FIG. 1 represents the position of the pivoting door 92 during storage outside the machine, during loading within the machine, and during operation when the toner container 53 is not rotated.

The device 40 of FIGS. 1 and 5 preferably is used in a copy or printing machine including driving mechanism 74 for rotating the device 40 in the direction of arrow 112. The driving mechanism 74 may have any suitable configuration but preferably includes a drive arm 110 which contacts a face 114 of the cover portion 96 of the pivoting door 92.

The pivoting door 92 may be made of any suitable, durable material but preferably is made of a plastic material. For example, the pivoting door 92 may be made of an acetal resin. The use of a acetal resin or similar material permits the arm 106 to deflect when pressure is placed by the driving mechanism 74 against face 114 of the cover portion 96 of the pivoting door.

Figure 2:
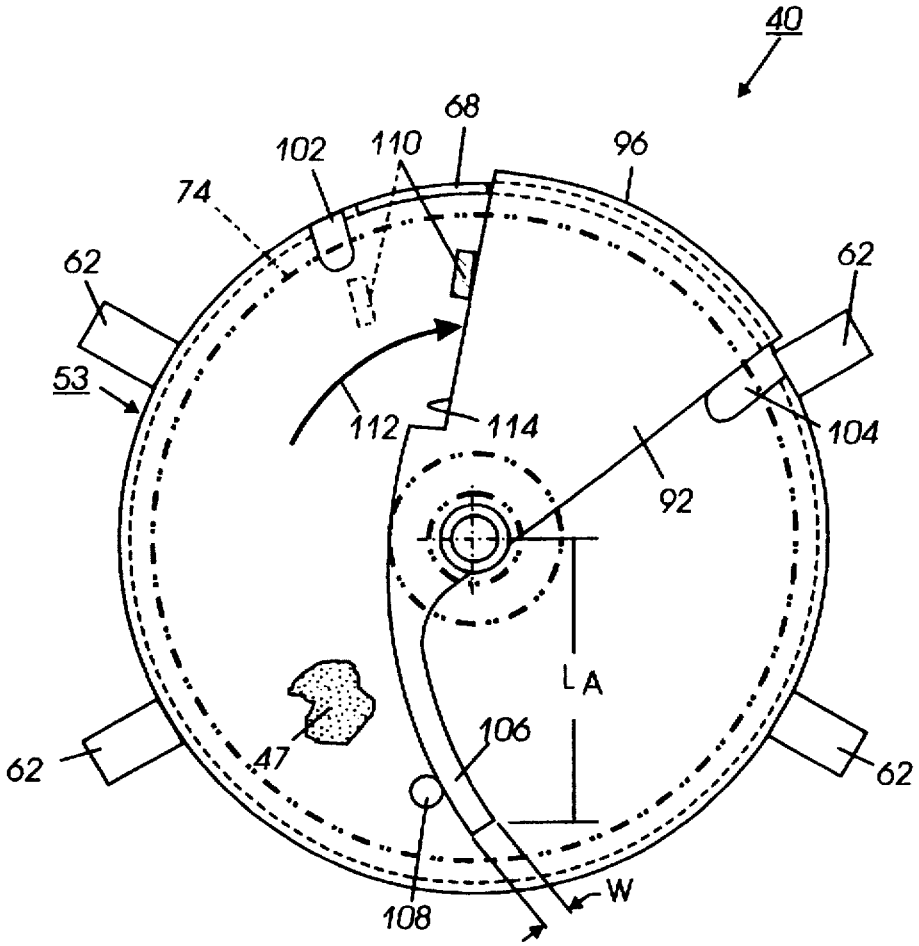
FIG. 2 is an end view of the FIG. 5 toner bottle showing the biased closure in the opened position.

Referring now to FIG. 2, the device 40 is shown with the driving mechanism 74 rotating the cover portion 96 of the door 92 into an opened position. The arm 110 of the driving mechanism 74 pushes against face 114 of the cover portion 96 until the cover portion 96 is stopped in its rotation in the direction of arrow 112 by door opened stop 104. In this position, the arm 106 is deflected as shown in FIG. 2. It should be appreciated that length $L_A$ and width W as well as the thickness (not shown) of the arm 106 need to be properly chosen to permit the deflection of the arm 106 without the permanent deformation or fracture thereof. By utilizing the device 40 of FIG. 2, with each rotation of the device 40, the opening 68 moves from its upper position as shown in FIG. 2 around to the lowest position and returns to its upper position. Thus, with each rotation of the device 40 an amount of material 47 is dispensed through the opening 68. Again, when the driving mechanism 74 no longer pushes against face 114 of the door 92, the door 92 closes over the opening 68 permitting any further leakage of material 47 from the device 40.

Figure 3:
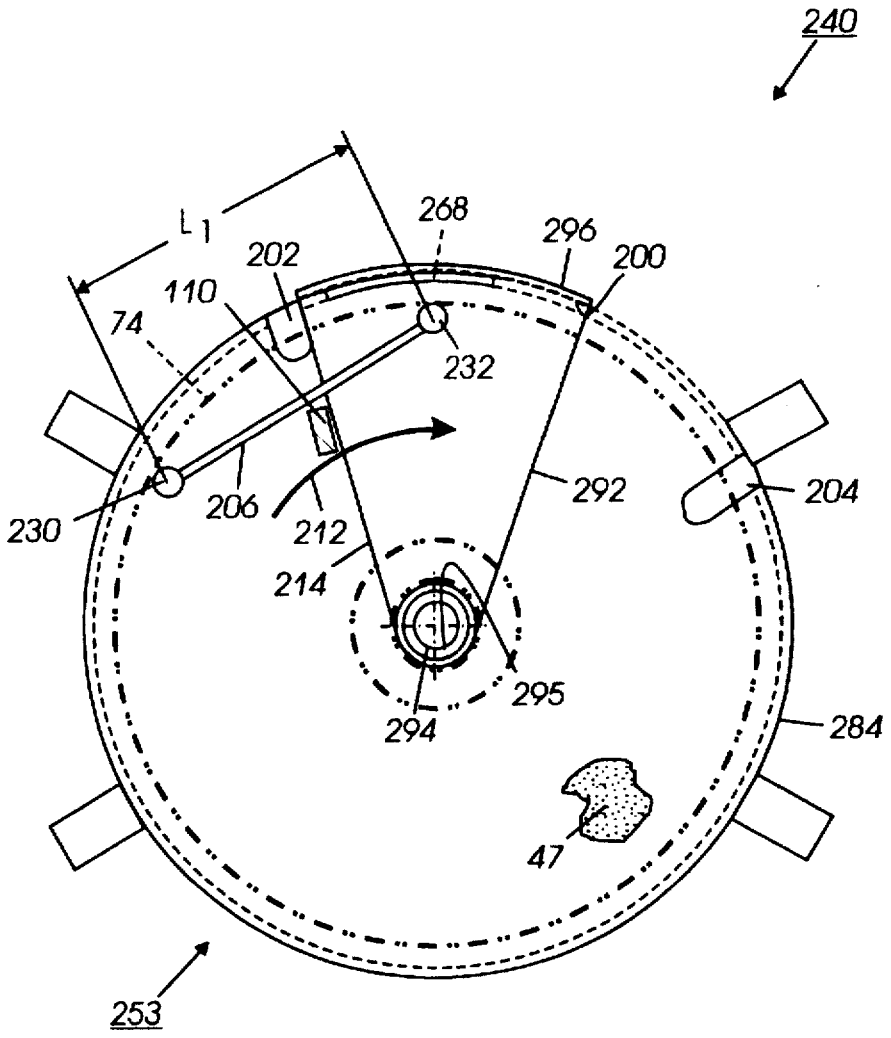
FIG. 3 is an end view of an alternate embodiment of a toner bottle having a biased closure according to the present invention with the biased closure in the closed position.

Referring now to FIG. 3, an alternate embodiment of the present invention is shown as device 240. The device 240 includes a container 253 similar to the container 53 of FIGS. 1, 2 and 5, including preferably integrally molded spiral ribs (not shown). The container 253 is made of a similar material as container 53 of FIGS. 1, 2 and 5. The device 240 further includes a member 292 in the form of a pivoting door. The door 292 is similar to door 92 of FIGS. 1 and 2 and preferably includes an aperture 295 therein which is matingly fit with a protrusion 294 extending from the container 253.

The door 292 includes an arcuately shaped cover 296 including an inner periphery 200 which is matingly fitted with outer periphery 284 of the container 253. The cover 296 is positioned to seal and cover an aperture in the form of opening 268 of the container 253. The door 292 is urged against door closed stop 202. Door closed stop 202 is similar to door closed stop 102 of the device 40 in FIGS. 1 and 2. When the device 240 is installed or removed and when the device 240 is not rotating, the drive face 214 of the door 292 is urged against door closed stop 202 by a spring 206. The spring 206 may be made of any suitable durable material capable of being elastic and have any suitable shape, e.g. be made of a metal or a polymer or have a shape such as a coil spring, a helical spring. Preferably, the spring 206 is in the form of an elastic connector. The elastic connector 206 may be mounted in the device 240 in any suitable fashion, e.g. the connector 206 may be in the form of an elastic band and mounted between a first protrusion 230 extending from the container 253 and a second protrusion 232 extending from the door 292. The connector 206 thus biases the drive face 214 against the door closed stop 202 thereby positioning the cover 296 to seal the opening 268.

Similar to the device 40, the device 240 cooperates with driving mechanism 74 is used to rotate the device 240 in the direction of arrow 212. Arm 110 of the driving mechanism 74 contacts face 214 of the door 292 urging it in the direction of arrow 212. The door 292 may be made of any suitable durable material, i.e. acetal, polypropylene, or polyethylene.

Figure 4:
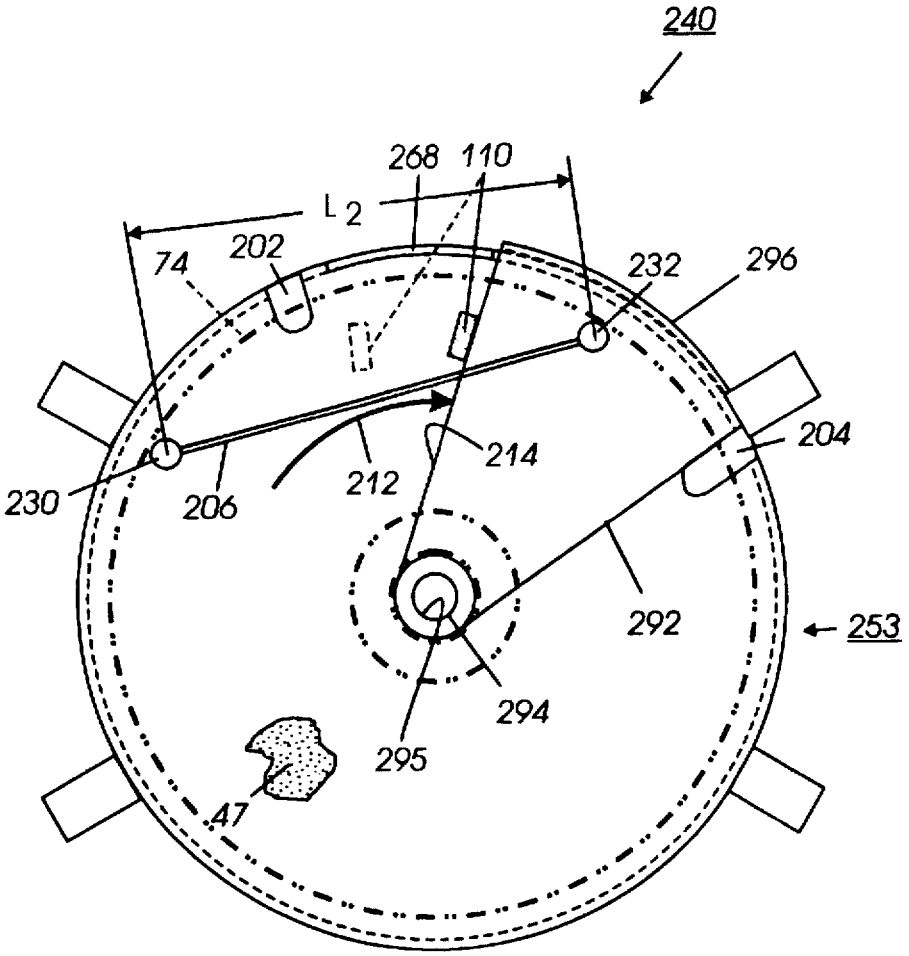
FIG. 4 is an end view of toner bottle of FIG. 3 with the biased closure in the opened position.

Referring now to FIG. 4, the device 240 is shown with the driving mechanism 74 engaging arm 110 against the door 292. The mechanism 74 urges the device 240 in the direction of arrow 212 and causes the door 292 to rotate against door opened stop 204. The connector 206 is permitted to expand to a length L2 which is substantially greater than the length L1 of the connector as shown in FIG. 3. It should be appreciated that the connector 206 should be selected to permit the amount of expansion required to expand from length L1 to length L2. With each rotation of the device 240, the opening 268 rotates from its position as shown in FIG. 4 in the upper portion of the device to a position in the bottom of the device 240 so that a controlled amount of material 47 may be dispersed to the developer unit (not shown).

By providing a toner container having a door for selectively opening and closing the aperture, a cylindrical toner container can be provided which may be positioned in any angular location as it is installed into the copy machine or printer.

By providing a toner container having a shutter type door, a toner container may be provided with loading and unloading capability in the closed position and provided with an operating position that permits the dispensing of marking particles.

By providing a toner container which has a shutter biased in the closed position during load and unload and biased in the open position during dispensing, a toner container can be provided that does not require an operator to remove a seal.

By providing a toner container including a pivoting door that pivots to open and close an aperture, a toner container can be provided which dispenses a controlled amount of toner with each revolution and yet not require a particular orientation during installation.

By providing a toner container with a pivoting door that is biased in a closed position during load and unload and is driven to open the door as it rotates, controlled dispensing can occur.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A device for storing a supply of particles for use in a developer unit of an electrophotographic printing machine, the device cooperable with a mechanism to feed the particles from the device into the developer unit, the device comprising:

a container defining a chamber for storing particles therein, said container defining an aperture therein; and a cover member operably associated with the container for selectively opening and closing the aperture, said cover member including an urging member integral with said cover member for urging the cover member toward one of an open position of said cover member and a closed position of said cover member, the mechanism being connectable to said cover member.

2. A device for storing a supply of particles for use in a developer unit of an electrophotographic printing machine, the device cooperable with a mechanism to feed the particles from the device into the developer unit, the device comprising:

a container defining a chamber for storing particles therein, said container defining an aperture therein, said container being defined by a generally cylindrical shape, said container being rotatable about a longitudinal axis thereof; and a cover member operably associated with the container for selectively opening and closing the aperture, said cover member including an urging member integral with said cover member for urging the cover member toward one of an open position of said cover member and a closed position of said cover member, the mechanism being connectable to said cover member and to said container for permitting the mechanism to rotate said container.

3. A device according to claim 2, wherein the mechanism is connectable to said cover member and said urging member is connected to said container so that the aperture is openable concurrently with the rotation of the container by the mechanism.

4. A device according to claim 3, wherein said cover member is pivotably mounted to said container.

5. A device for storing a supply of particles for use in a developer unit of an electrophotographic printing machine, the device cooperable with a mechanism to feed the particles from the device into the developer unit, the device comprising:

a container defining a chamber for storing particles therein, said container defining a aperture therein, said container rotatable about a longitudinal axis thereof;

a member pivotably mounted to said container for selectively opening and closing the aperture, the mechanism is connectable to said member and to said container for permitting the mechanism to rotate said container, the mechanism being connectable to said member and said member being connected to said container so that the aperture is openable concurrently with the rotation of the container by the mechanism; and an elastic connector connecting said member to said container whereby said member is rotatable away from the aperture of said container as the connector stretches to rotate the container as the mechanism rotates the member.

6. A device for storing a supply of particles for use in a developer unit of an electrophotographic printing machine, the device cooperable with a mechanism to feed the particles from the device into the developer unit, the device comprising:

a container defining a chamber for storing particles therein, said container defining a aperture therein, said container rotatable about a longitudinal axis thereof; and a member pivotably mounted to said container for selectively opening and closing the aperture, the mechanism is connectable to said member and to said container for permitting the mechanism to rotate said container, the mechanism being connectable to said member and said member being connected to said container so that the aperture is openable concurrently with the rotation of the container by the mechanism, said member including an arm, said arm connecting said member to said container whereby said member is rotatable away from the aperture of said container as the arm is deflected to rotate the container as the mechanism rotates the member.

7. A developer unit for developing a latent image recorded on an image receiving member with a supply of particles, the developer unit including a device cooperable with a mechanism to feed the particles from the device into the developer unit, said device comprising:

a container defining a chamber for storing particles therein, said container defining an aperture therein; and a cover member operably associated with the container for selectively opening and closing the aperture, said cover member including an urging member integral with said cover member for urging the cover member toward one of an open position of said cover member and a closed position of said cover member, the mechanism being connectable to said cover member.

8. A developer unit for developing a latent image recorded on an image receiving member with a supply of particles, the developer unit including a device cooperable with a mechanism to feed the particles from the device into the developer unit, said device comprising:

a container defining a chamber for storing particles therein, said container defining an aperture therein, said container being defined by a generally cylindrical shape, said container being rotatable about a longitudinal axis thereof; and a cover member operably associated with the container for selectively opening and closing the aperture, said cover member including an urging member integral with said cover member for urging the cover member toward one of an open position of said cover member and a closed position of said cover member, the mechanism being connectable to said cover member and to said container for permitting the mechanism to rotate said container.

9. A developer unit according to claim 8, wherein the mechanism is connectable to said cover member and said urging member is connected to said container so that the aperture is openable concurrently with the rotation of the container by the mechanism.

10. A developer unit according to claim 9, wherein said cover member is pivotably mounted to said container.

11. A developer unit for developing a latent image recorded on an image receiving member with a supply of particles, the developer unit including a device cooperable with a mechanism to feed the particles from the device into the developer unit, said device comprising:

a container defining a chamber for storing particles therein, said container defining a aperture therein, said container rotatable about a longitudinal axis thereof;

a member pivotably mounted to said container for selectively opening and closing the aperture, the mechanism is connectable to said member and to said container for permitting the mechanism to rotate said container, the mechanism being connectable to said member and said member being connected to said container so that the aperture is openable concurrently with the rotation of the container by the mechanism; and an elastic connector connecting said member to said container whereby said member is rotatable away from the aperture of said container as the connector stretches to rotate the container as the mechanism rotates the member.

12. A developer unit for developing a latent image recorded on an image receiving member with a supply of particles, the developer unit including a device cooperable with a mechanism to feed the particles from the device into the developer unit, said device comprising:

a container defining a chamber for storing particles therein, said container defining a aperture therein, said container rotatable about a longitudinal axis thereof; and a member pivotably mounted to said container for selectively opening and closing the aperture, the mechanism is connectable to said member and to said container for permitting the mechanism to rotate said container, the mechanism being connectable to said member and said member being connected to said container so that the aperture is openable concurrently with the rotation of the container by the mechanism, said member including an arm, said arm connecting said member to said container whereby said member is rotatable away from the aperture of said container as the arm is deflected to rotate the container as the mechanism rotates the member.

13. A printing machine for developing with a supply of particles a latent image recorded on an image receiving member, said machine including a developer unit, the developer unit including a device cooperable with a mechanism to feed the particles from the device into the developer unit, said device comprising:

a container defining a chamber for storing particles therein, said container defining an aperture therein; and a cover member operably associated with the container for selectively opening and closing the aperture, said cover member including an urging member integral with said cover member for urging the cover member toward one of an open position of said cover member and a closed position of said cover member, the mechanism being connectable to said cover member.

14. A printing machine An electrophotographic copy machine for developing with a supply of particles a latent image recorded on an image receiving member, said copy machine including a developer unit, the developer unit including a device cooperable with a mechanism to feed the particles from the device into the developer unit, said device comprising:

a container defining a chamber for storing particles therein, said container defining an aperture therein, said container being defined by a generally cylindrical shape, said container being rotatable about a longitudinal axis thereof; and a cover member operably associated with the container for selectively opening and closing the aperture, said cover member including an urging member integral with said cover member for urging the cover member toward one of an open position of said cover member and a closed position of said cover member, the mechanism being connectable to said cover member and to said container, for permitting the mechanism to rotate said container.

15. A printing machine according to claims 14, wherein the mechanism is connectable to said cover member and said urging member is connected to said container so that the aperture is openable concurrently with the rotation of the container by the mechanism.

16. A printing machine according to claim 15, wherein said urging member is pivotably mounted to said container.

17. An electrophotographic printing machine for developing with a supply of particles a latent image recorded on an image receiving member, said printing machine including a developer unit, the developer unit including a device cooperate with a mechanism to feed the particles from the device into the developer unit, said device comprising:

a container defining a chamber for storing particles therein, said container defining a aperture therein, said container rotatable about a longitudinal axis thereof;

a member pivotably mounted to said container for selectively opening and closing the aperture, the mechanism is connectable to said member and to said container for permitting the mechanism to rotate said container, the mechanism being connectable to said member and said member being connected to said container so that the aperture is openable concurrently with the rotation of the container by the mechanism; and an elastic connector connecting said member to said container whereby said member is rotatable away from the aperture of said container as the connector stretches to rotate the container as the mechanism rotates the member.

18. An electrophotographic printing machine for developing with a supply of particles a latent image recorded on an image receiving member, said printing machine including a developer unit, the developer unit including a device cooperable with a mechanism to feed the particles from the device into the developer unit, said device comprising:

a container defining a chamber for storing particles therein, said container defining a aperture therein, said container rotatable about a longitudinal axis thereof; and a member pivotably mountd to said container for selectively opening and closing the aperture, the mechanism is connectable to said member and to said container for permitting the mechanism to rotate said container, the mechanism being connectable to said member and said member being connected to said container so that the aperture is openable concurrently with the rotation of the container by the mechanism, said member including an arm, said arm connecting said member to said container whereby said member is rotatable away from the aperture of said container as the arm is deflected to rotate the container as the mechanism rotates the member.

* * * * *